US006926422B2

(12) United States Patent
Bruwer et al.

(10) Patent No.: US 6,926,422 B2
(45) Date of Patent: Aug. 9, 2005

(54) FLASHLIGHT

(75) Inventors: Frederick Johannes Bruwer, Paarl (ZA); Terence Erasmus, Cape Town (ZA)

(73) Assignee: Azoteq (Pty) Ltd., Paarl (ZA)

( * ) Notice: Subject to any disclaimer, the term of this patent is extended or adjusted under 35 U.S.C. 154(b) by 120 days.

(21) Appl. No.: 10/674,392

(22) Filed: Oct. 1, 2003

(65) Prior Publication Data

US 2005/0052862 A1 Mar. 10, 2005

(30) Foreign Application Priority Data

Sep. 9, 2003 (ZA) ..... 2003/6949

(51) Int. Cl.[7] ..... F21L 4/04

(52) U.S. Cl. ..... 362/157; 362/165; 362/191; 362/200; 362/285

(58) Field of Search ..... 362/165, 285, 362/157, 190, 196, 202–205, 208

(56) References Cited

U.S. PATENT DOCUMENTS 5,541,822 A * 7/1996 Bamber ..... 362/190

* cited by examiner

*Primary Examiner*—Sandra O'Shea
*Assistant Examiner*—Mark Tsidulko
(74) *Attorney, Agent, or Firm*—Jones, Tullar & Cooper, P.C.

(57) ABSTRACT

A flashlight includes a body with first and second opposed ends, an enclosure for at least one battery which is defined between the first and second ends, and a non-circular mouth at the first end, a head which is engageable with the mouth, and at least one clip which is engageable with the head and the body thereby to secure the head to the body. The body may include at least a first fixing formation and the head may include at least a second fixing formation, and the clip may have formations which are complementary to, and which are engageable with, the first and second fixing formations. The clip may be movable between a first position at which the clip engages fully with the fixing formation or formations on the body or head, and a second position at which the clip is fully disengaged from the fixing formation or formations.

14 Claims, 7 Drawing Sheets

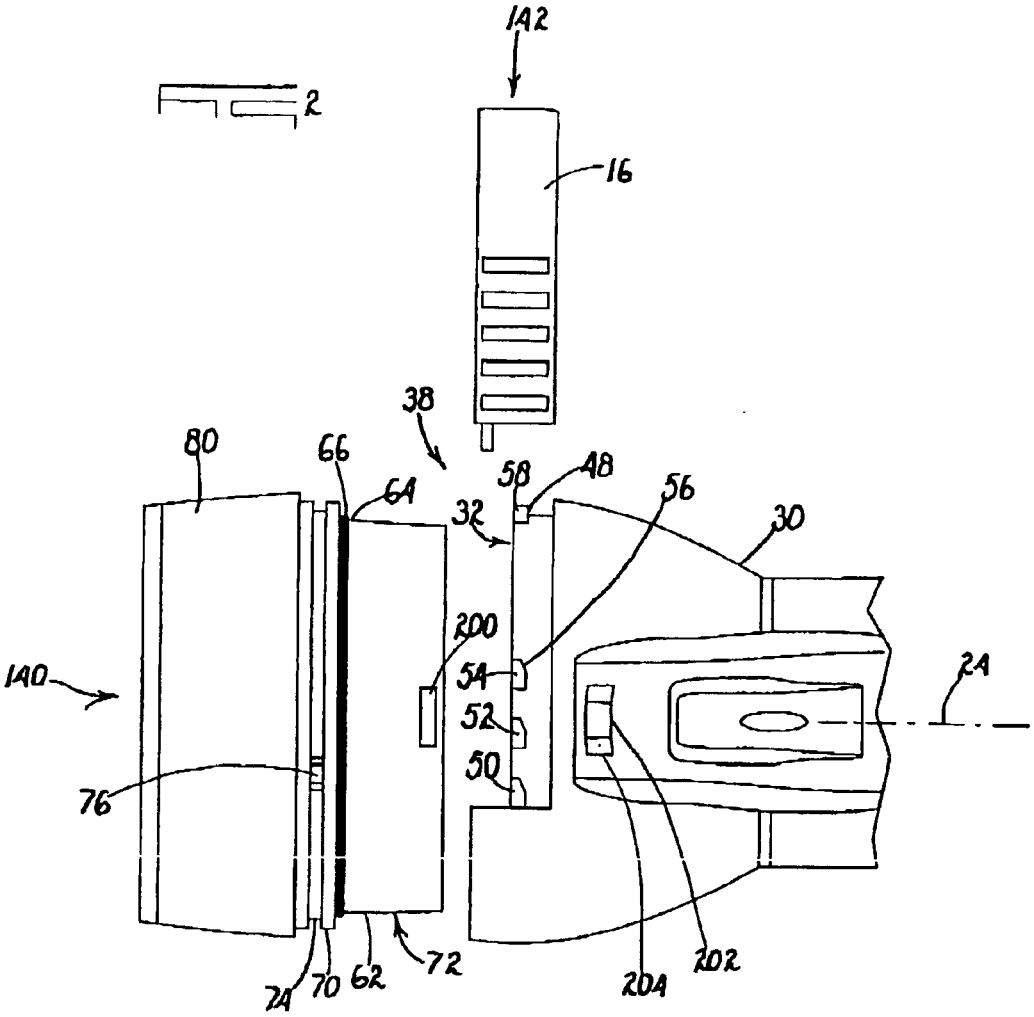
2
142
16
38
80
66
64
58
48
56
30
32
200
140
54
24
52
50
76
74
70
62
72
204
202
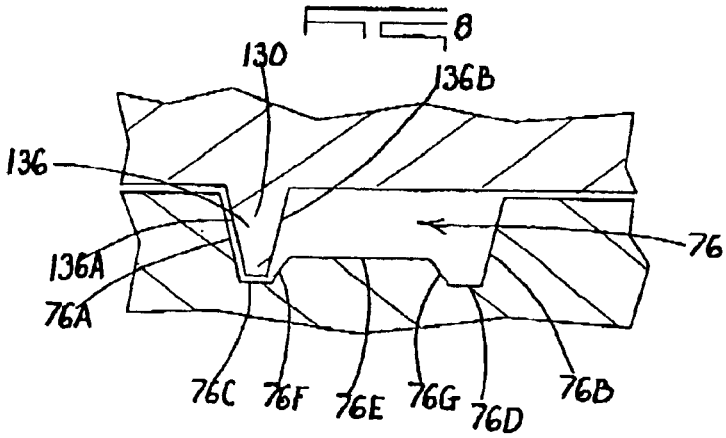
8
130
136B
136
76
136A
76A
76C
76F
76E
76G
76D
76B

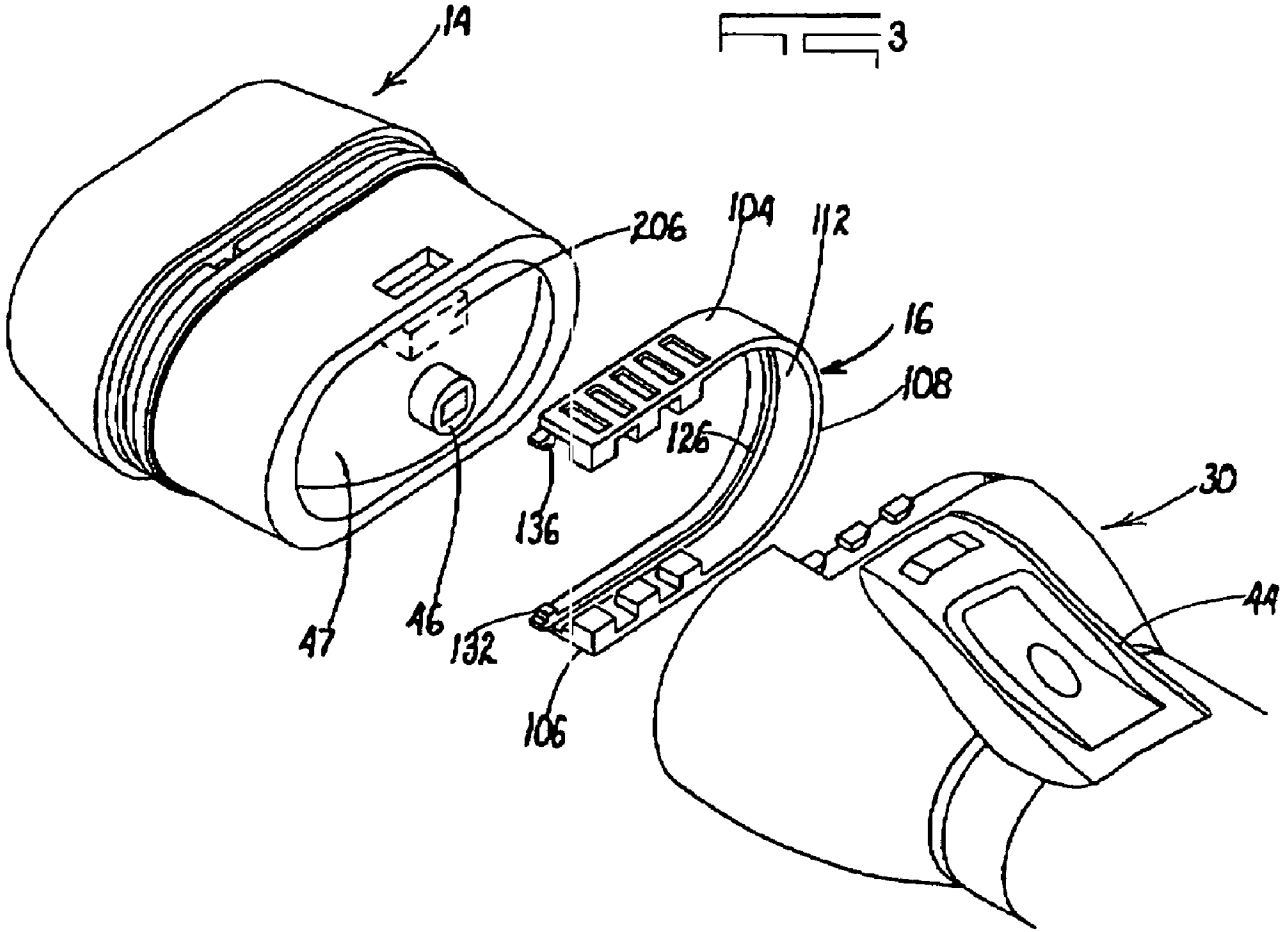
3
14
206
104
112
16
108
30
44
126
136
132
106
46
47

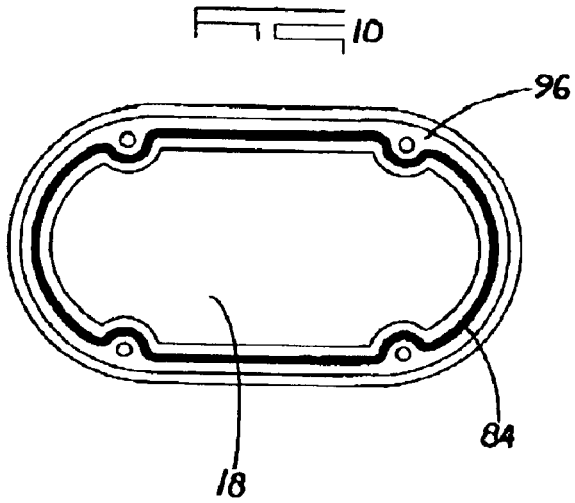
10
96
84
18
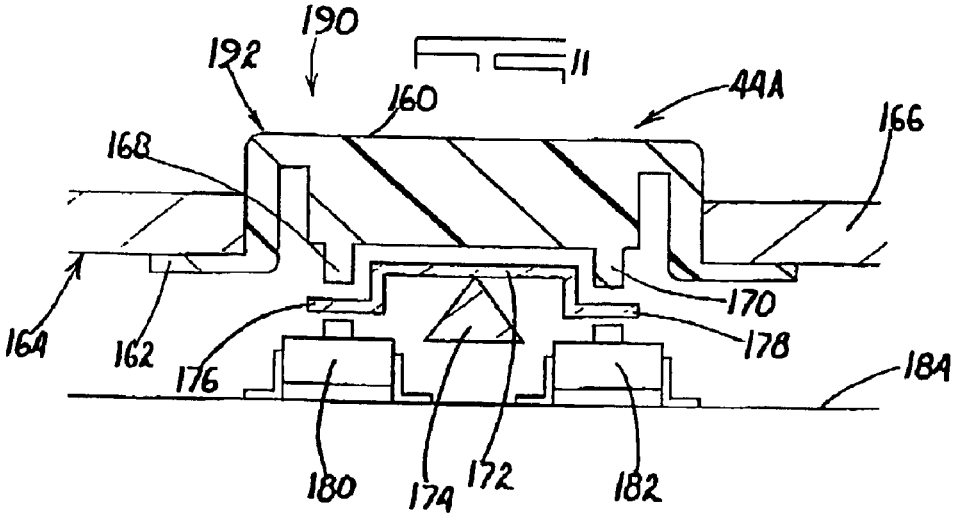
190
192
11
160
44A
168
166
170
164
162
176
178
184
180
174
172
182

FLASHLIGHT

BACKGROUND OF THE INVENTION

This invention relates to a flashlight and to a housing or body, which is particularly suited for a flashlight, which is not circular cylindrical.

A typical flashlight has a circular cylindrical body which is engaged with a head and a tail cap. At least one of the head and tail cap is engaged with the body by means of a screw mechanism with complementary screw threads being formed on those parts of the components which are to be screwed together. The widespread use of a circular cylindrical body, in a flashlight, can probably be attributed to the fact that batteries have a similar shape, and to the ease of creating screw threads on circular components as a means of engaging the components with each other.

A flashlight which is based on a round or a circular design does not necessarily give a high packing density, is prone to rolling and often has a shape or appearance which is aesthetically unappealing.

Another factor which is encountered particularly when an interior of a flashlight is to be sealed from atmosphere, eg. for waterproofing or safety reasons, is that if a seal such as an O-ring is positioned between two parts which are to be screwed together, the O-ring can be subjected to forces which do not lie perpendicular to the plane occupied by the O-ring and this can cause damage to the O-ring.

SUMMARY OF INVENTION

The invention provides a flashlight which includes a body with first and second opposed ends, an enclosure for at least one battery which is defined between the first and second ends, and a non-circular mouth at the first end, a head which is engageable with the mouth, and at least one clip which is engageable with the head and the body thereby to secure the head to the body.

The body in cross section, at the mouth, is non-circular and thus not well suited to being coupled to the head by means of a screw thread.

The second end may include a cover which is removable to provide access to the enclosure. Preferably though access to the enclosure is provided through the mouth. The second end may be closed in a permanent manner.

The body may include at least a first fixing formation and the head may include at least a second fixing formation, and the clip may have formations which are complementary to, and which are engageable with, the first and second fixing formations.

A seal may be located between opposing surfaces of the body and the head to seal at least the enclosure.

The seal may be so positioned that during engagement of the head with the body minimal or no scraping, rolling, tearing, dragging or shearing motion is applied to the seal but rather only a pressing motion which results in a compressive force being applied to the seal.

The clip, when engaged with the body and the head, may overlie portions of the outer surface of the body and the outer surface of the head.

The body may have a longitudinal axis and the head may be engageable with the mouth by moving the head towards the body in the direction of the longitudinal axis. The clip may be engageable with the head and the body by moving the clip in a direction which is transverse to the longitudinal axis.

The clip may be of any appropriate shape and for example may be U-shaped.

Preferably the mouth of the body is substantially oval in outline and is formed on an outwardly bulging portion of the body. Without being restrictive the mouth may include two relatively long and substantially linear sections which oppose one another and two opposing arcuate sections which respectively extend from ends of the linear sections.

Preferably at least one of the fixing formations on the body and on the head, or at least one of the complementary formations on the clip, has a surface which is inclined to the transverse direction so that the head and body are drawn closer towards each other as the clip is moved in the transverse direction during the attachment process.

The clip may be movable between a first position at which the clip engages fully with the fixing formation or formations on the body or head, and a second position at which the clip is fully disengaged from the fixing formation or formations.

The head may define a housing for at least one light emitting device and include a lens which is engageable with the housing and a seal which is positioned between opposing surfaces of the lens and the head.

Preferably the head has an opening to the housing and a ledge which is located on an inner surface of the housing which extends continuously around the opening. The seal may be located on the ledge and a peripheral edge of the lens may rest on the seal.

A securing device may be used to secure the lens to the head. The manner in which this is done preferably allows the lens to move slightly towards or away from the head. Preferably the arrangement is such that the lens is urged into tighter engagement with the seal if the lens is exposed to an external pressure while, if the interior of the body, ie. the enclosure, is pressurised the lens is capable of moving slightly away from the ledge. This action enhances the efficacy of the seal as the external pressure increases but allows the pressure in the body interior to be reduced by letting gas escape from the body interior when the pressure in the body interior increases, relatively to the external pressure, by at least a predetermined amount.

BRIEF DESCRIPTION OF THE DRAWINGS

The invention is further described by way of examples with reference to the accompanying drawings in which:

FIG. 2 is a side view on an enlarged scale of portion of the flashlight shown in FIG. 1 illustrating components of the flashlight in an exploded configuration;

FIG. 3 is a perspective view from a rear side of the components shown in FIG. 2;

FIGS. 7 and 8 are enlarged views in section of part of the components shown in FIG. 5;

FIG. 10 is a front view of the flashlight, showing the lens; and

FIG. 11 illustrates somewhat schematically the working of a switch of the flashlight.

DESCRIPTION OF PREFERRED EMBODIMENTS

Figure 1:
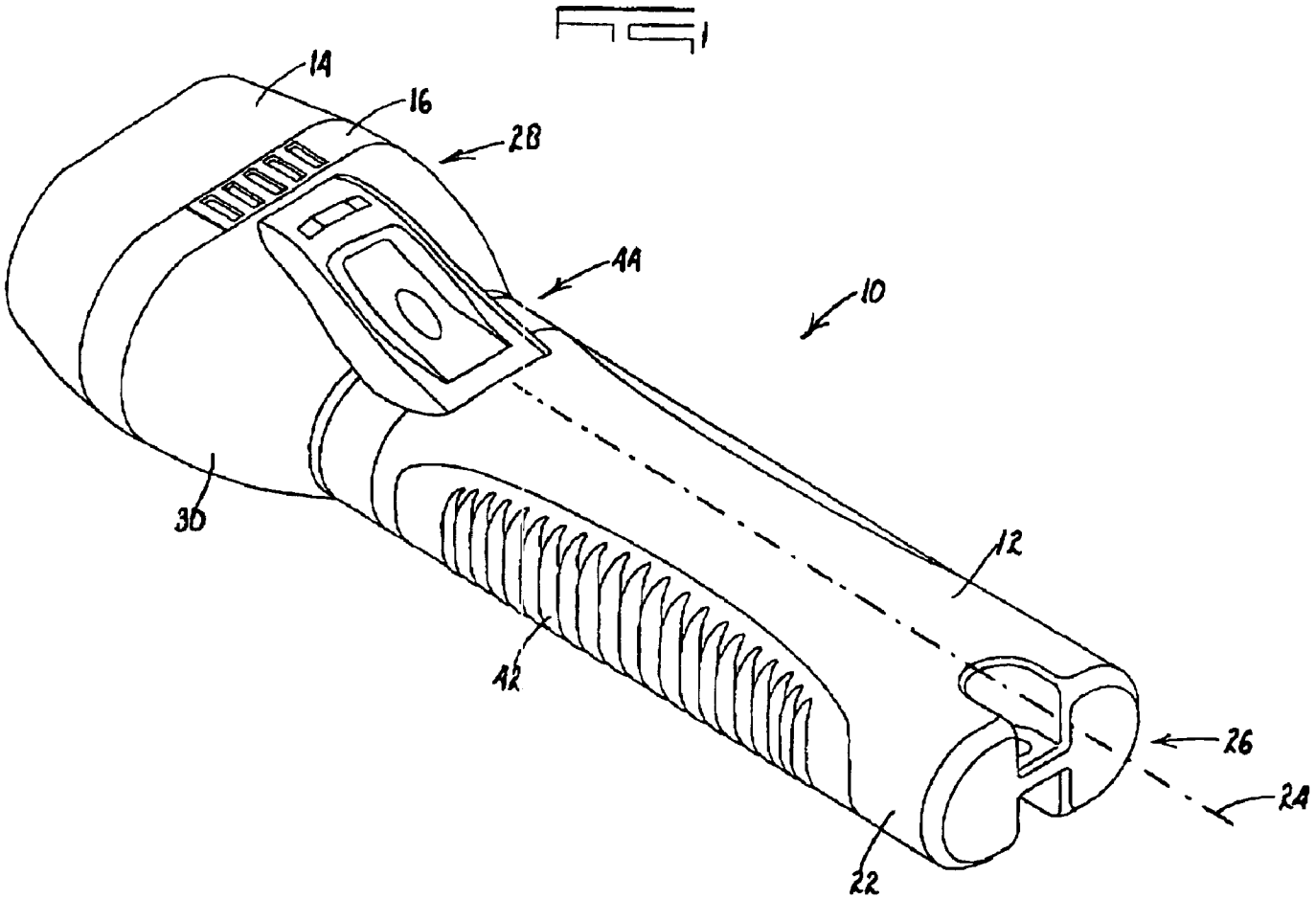
FIG. 1 is a perspective view of an assembled flashlight according to the invention.
Figure 4:
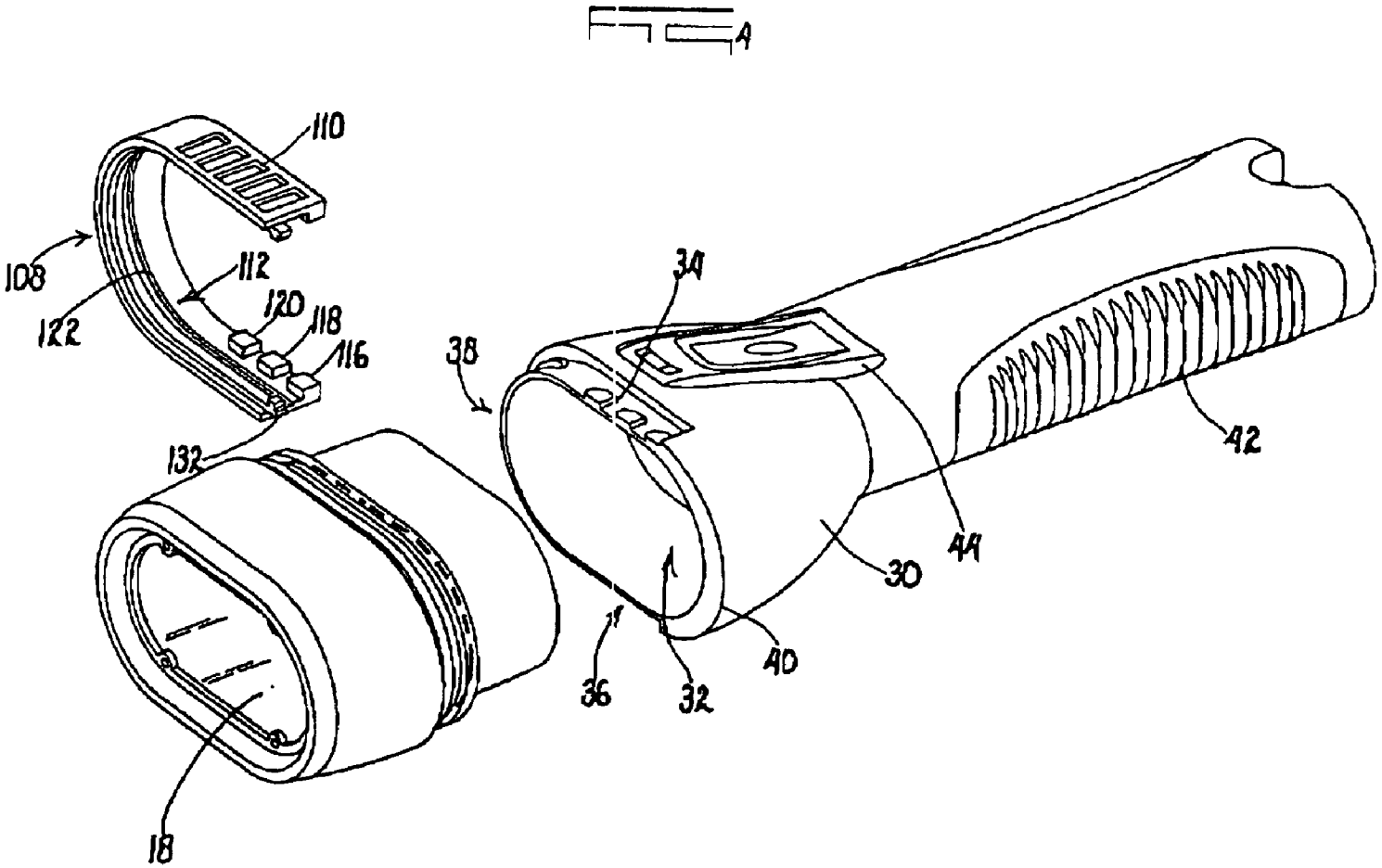
FIG. 4 is a perspective view from a front side of the components of FIG. 2.

FIG. 1 of the accompanying drawings illustrates a flashlight 10 according to the invention which includes a body 12, a head 14 and a clip 16. As is shown in FIG. 4 a lens 18 is attached to the head.

The body 12 has an elongate section 22 which has a longitudinal axis 24. The section 22, at one end 26, is closed in a permanent fashion and, at an opposing end 28, flares into an outwardly bulging section 30 which terminates, as is shown in FIG. 4, in a non-circular mouth 32 which, in this case, is substantially oval. The mouth has two opposed substantially linear sides 34 and 36 which are relatively long and two opposed arcuate sections 38 and 40 respectively which are more or less semi-circular and which extend between respective ends of the opposed linear sections 34 and 36.

Inserts 42 of rubber or an equivalent material are optionally provided on opposed sides of the section 22 as handle grips.

A switch arrangement 44 is provided on an exterior surface of the body bridging the junction of the section 22 and the section 30.

The body 12 forms an enclosure, access to which is provided via the mouth 32, for one or more batteries, not shown, which are housed inside the enclosure.

As is shown in FIG. 3 at least one light emitting device 46, such as a light emitting diode or an incandescent globe is mounted on structure 47 inside the head 14. When the head is assembled on the body, as is shown in FIG. 1, the battery or batteries inside the body are used to provide electrical energy to energise the light emitting device. The application of the electrical energy to the light emitting device is controlled by means of the switch arrangement 44 which, in the illustrated embodiment, is attached to the body. This need not necessarily be the case for in an alternative embodiment the switch arrangement and any electronic circuitry which may be associated therewith, used for controlling the operation of the flashlight, may be mounted to the head. Any appropriate technique may be used for securing the switch arrangement and the electronics, if used, to the flashlight.

In a general sense it can be said that the actuation and operation of a flashlight using batteries or storage cells are well known in the art and for this reason are not further described in detail herein. The following description is essentially confined to structural aspects of the flashlight.

Referring particularly to FIGS. 2 to 6 the section 30 adjacent the mouth 32 is formed with a shoulder 48 which extends substantially along the sides 34 and 36 and the side 38. Each of the sides 34 and 36 is formed with three projections 50, 52 and 54 respectively which have inclined leading surfaces 56. The number of projections can vary though from one to four or even higher. A U-shaped rib 58 extends continuously around the side 38.

Figure 5:
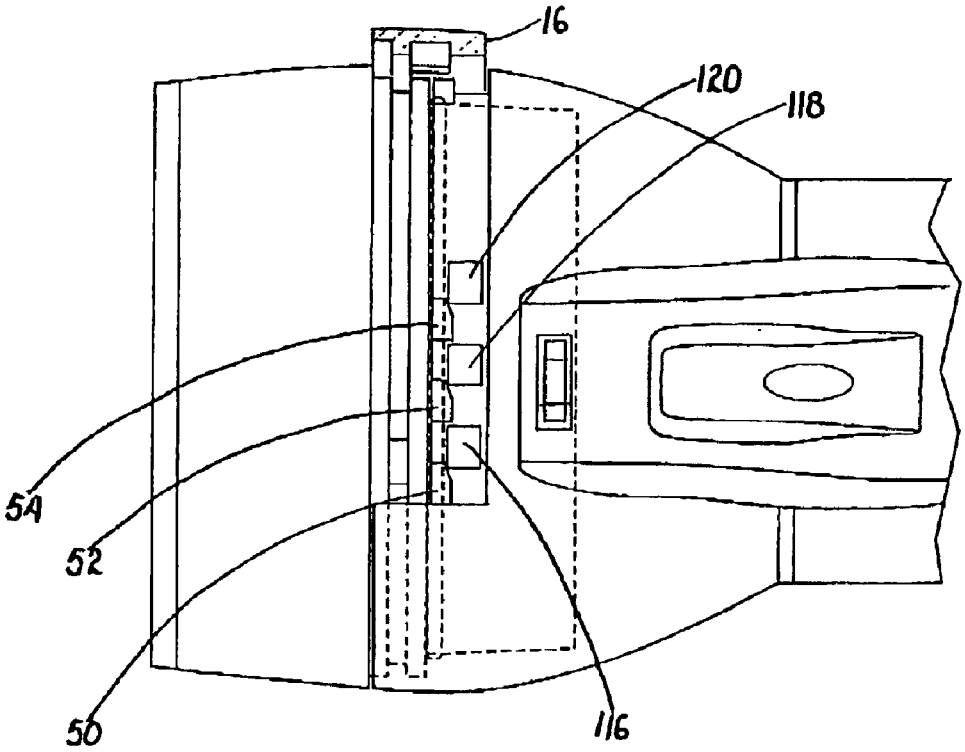
FIGS. 5 and 6 show the components of FIG. 2, partly sectioned, in successive stages of being engaged with one another.
Figure 6:
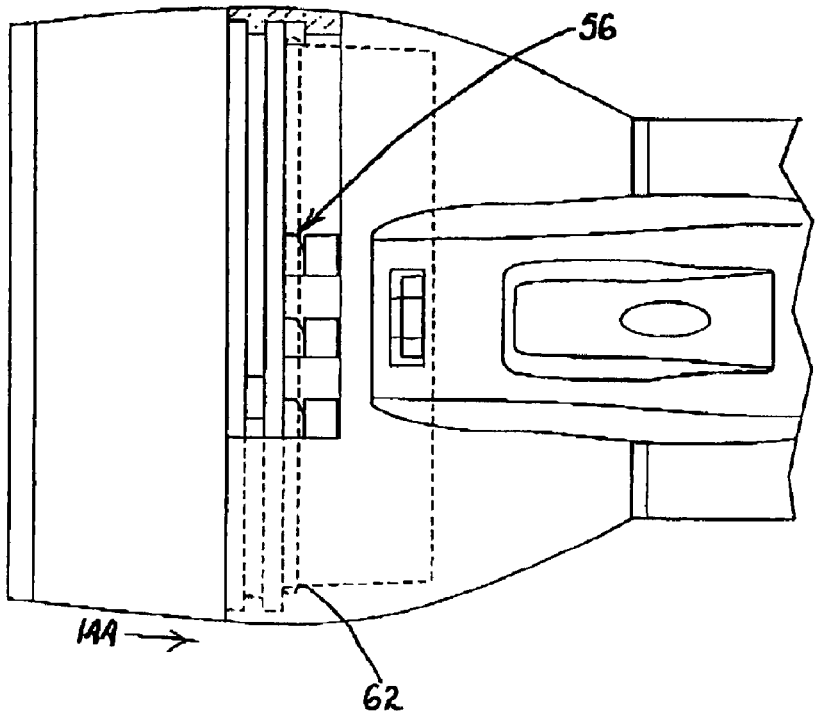

The head 14 includes a short tubular sleeve portion 62, shown in dotted lines in FIGS. 5 and 6, which is slightly tapered and which is formed with a shallow groove 64 which accommodates an O-ring seal 66. The sleeve portion 62 is designed in such a way that it fits tightly into, and is intimately engaged with, the opposing body section 62A in order to provide additional strength for the flashlight in the region in which the head is attached to the body. This is a desirable feature. For example, if the flashlight is dropped and hits a surface at a slight inclination ie. with the longitudinal axis 24 not substantially vertical, the sleeve and the body will help adsorb some of the impact force and thereby protect the clip 16 and other structural components of the flashlight, at least to a limited extent, against damage.

A rib 70 stands proud of the surface 72 of the tubular portion and is flanked on one side by a groove 74. A short, shallow recess 76 is formed in a base of the groove. There are two recesses formed in the groove although, in the drawings, only one recess is visible.

Figure 9:
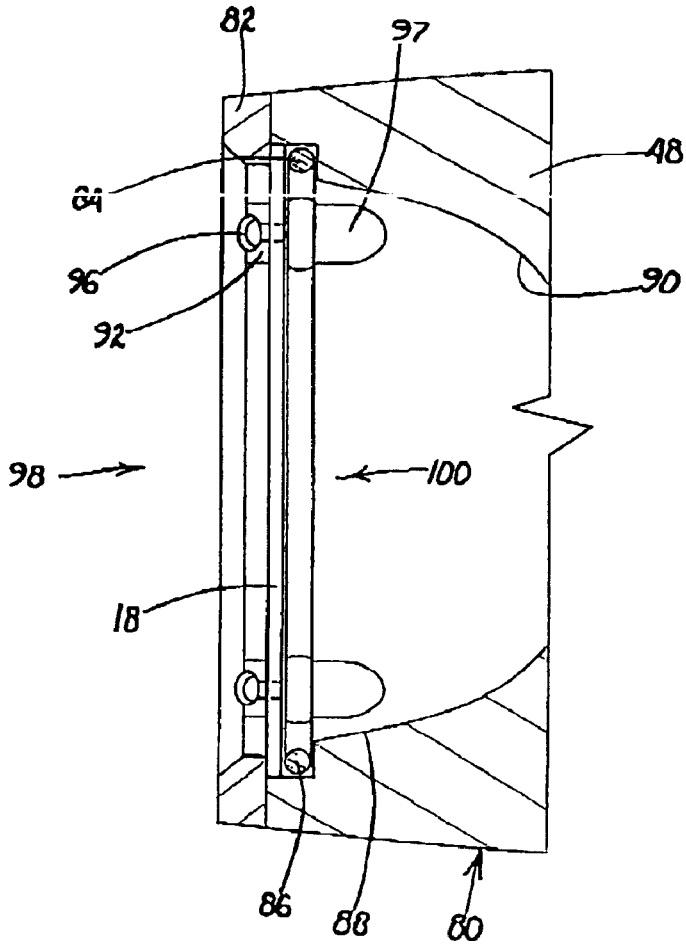
FIG. 9 is a cross sectional view from the side of a portion of the flashlight of FIG. 1 illustrating a lens which is engaged with a head of the flashlight.

The head has a rounded smoothly curved end section 80 adjacent the groove 74. As is shown in FIGS. 4, 9 and 10 the lens 18, which is kept in position by means of an annular cover 82, rests on an O-ring 84 which, in turn, is positioned on a ledge 86 which surrounds an opening 88 to a recessed inner surface 90 of the structure 48 contained within the section 80. The inner surface 90 is dished in any appropriate manner and optionally may include a reflector surface. The light emitting device 46, or each device if the flashlight includes a plurality of such devices, is mounted at a suitable location on the structure 48 or on other structure inside the head.

The lens 18 is made from any appropriate transparent material such as stiff plastics material or glass. The cover 82 has four small openings 92 and four domed spigots 96 which are integrally formed with the section 80 or which are attached thereto in any appropriate way extend through the openings 92 to secure the lens to the section. In an alternative form of construction the spigots are replaced by screws. The screws pass through the respective openings 92 and are threadedly engaged with holes which are formed in respective bosses 97 (see FIG. 9) in the section 80.

When the lens is secured to the section 80 the O-ring seal 84 is under a slight degree of compression. Nonetheless the arrangement is such that, to a limited extent, the lens is capable of moving towards the body in a direction 98 and away from the body in a direction 100. Clearly, in the inwards direction 98, the extent of movement is limited by the O-ring which rests on the ledge 86 while, in the reverse direction 100, the extent of movement is limited by the domed formations on the spigots, or by the screws, as the case may be. If screws are used to attach the cover to the section 80 it is possible to position a compressible washer between a head of each screw and an opposing surface of the cover 82 that presses against the lens. The washers, when compressed, allow a small degree of relative movement of the lens away from the head.

As is shown particularly in FIGS. 3 and 4 the clip 16 is generally U-shaped with opposing limbs 104 and 106 which are relatively straight and a curved bridging piece 108 which interconnects the limbs 104 and 106.

The clip, on an outer surface, has knurled formations 110 which assist a user in manipulating the clip. On an inner surface 112 the clip is formed with opposed upstanding and spaced formations 116, 118 and 120 respectively and a continuous slot 122 which extends on an inner side of the bridging piece 108. The number of formations 116, etc is generally the same as the number of projections 50 etc.

A small ridge 126 is at a rim of the inner surface 112, and forms short extension pieces 130 and 132 respectively at leading ends of the limbs 104 and 106. Each extension piece has a small inwardly extending projection 136.

FIG. 1 shows the flashlight in an assembled condition wherein the clip 16 is positioned at a junction of, and overlies portions of, the head and the body.

When the head is to be engaged with the body the tubular portion 62 of the head, which carries the O-ring 66, is inserted into the mouth 32 of the section 30 of the body. The design of the portion 62 and of the section 30 is such that the O-ring 66 is only compressed when the portion 62 is fully inserted into the mouth. There is little or no tendency for the seal 66 to roll over the tubular portion as the portion is pushed into the mouth. This ensures that the seal 66 remains firmly engaged with the groove 64 during normal assembly and disassembly of the flashlight and the risk of accidental damage to the seal is reduced.

The head is engaged with the body by moving the head in the direction of an arrow 140, see FIG. 2, which is substantially in line with the longitudinal axis 24 of the body. On the other hand when the clip 16 is engaged with the head and the body, the clip is moved in a direction 142 which is more or less at a right angle to the direction 140. At this time the O-ring is further compressed between opposing surfaces of the rib 70 and the rim of the section 30 which surrounds the mouth 32. The clip is positioned so that limbs 104 and 106 are adjacent, but extend over, the curved side 38 of the mouth and as the clip is moved in the direction 142 the projections 136 ride inside corresponding portions of the groove 74.

FIG. 5 shows the clip 16 at a near limiting first position which occurs when the formations 116, 118 and 120 respectively come into engagement with the respective inclined leading surfaces 56 of the projections 50, 52 and 54 at the mouth of the body. The formations 52 to 54, and 116 to 120, are respectively sized and shaped so that in order to push the clip to the position shown in FIG. 6 the formations 116 to 120 must ride over the leading surfaces 56 of the respective formations 50 to 54 and, in so doing, the head 14 is moved further towards the body as is indicated by an arrow 144 in FIGS. 5 and 6. In the process, the O-ring seal 66, which is carried on the tapered tubular portion 62, is compressed between opposing surfaces of the head, at the junction of the tubular portion 62 and the section 80, and an inner surface of the section 30 adjacent the mouth 32.

Figure 7:
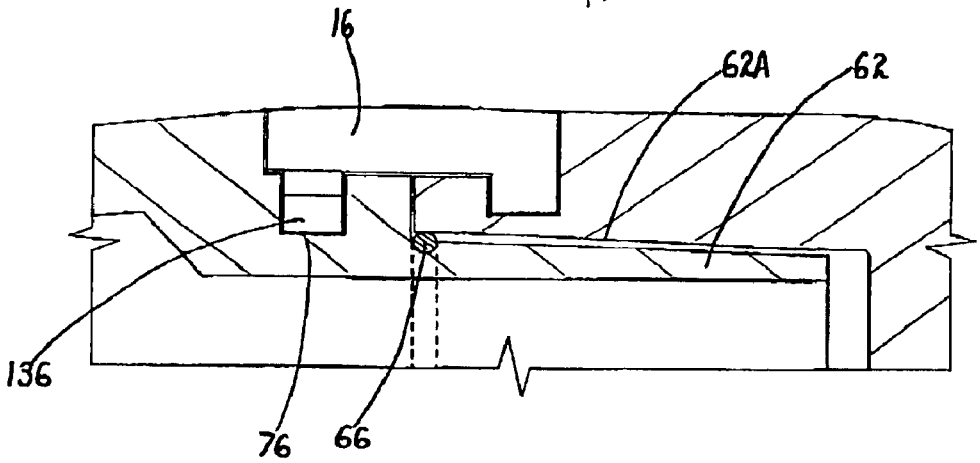

FIGS. 6 and 7 are views at a right angle to each other and illustrate, in cross section and on different scales, the configuration when the clip 16 is pushed fully home. The formations 116, 118 and 120 are respectively urged, against a force which results from compression of the seal 66, to positions adjacent the formations 50, 52 and 54 respectively. The projections 136, on opposed internal extremities of the clip, are moved into the respective shallow recesses 76 on opposed sides of the groove 74. The rib 58 on the section 30 fits snugly into the slot 122 on the bridging piece 108 of the clip.

It is clear from the aforegoing that the clip, when it is pushed to the position shown in FIGS. 1 and 6, draws the head into a firm engagement with the body with a seal between opposed surfaces of the head and the body being provided by the seal 66 which is slightly compressed in the process. A firm mechanical interlock between the head and the body is provided by the interlocking formations 50 to 54, and 116 to 120, on the one hand and by the engagement of the rib 58 with the slot 122 on the other hand. The projections 136 which nestle in the recesses 76 ensure that the clip 16 cannot inadvertently slide out of engagement from the head and the body.

It is to be understood that it will be necessary, from time to time, to gain access to the interior of the body in order to replace the battery or batteries which are housed in the body with fresh batteries. It may also be necessary from time to time to access the head 14 and replace the light emitting device or devices fixed to the head. When it is necessary to access the interior of the body the clip is readily released by prising the limbs 104 and 106 outwardly to a slight extent so that the projections 136 disengage from the corresponding recesses 76. The clip can then be slid away from the body and the head in a direction which is opposite to the direction 142 shown in FIG. 2.

FIG. 8 illustrates in enlarged detail a preferred form of construction for the recess 76 and the projection 136 on the extension piece 130 of the clip. The other extension piece 132 has a similar construction.

The recess 76 has steeply sloping side walls 76A and 76B respectively which extend to shallow grooves 76C and 76D respectively. A centrally positioned flat base 76E extends between the shallow grooves 76C and 76D. Each groove has a respective side wall 76F and 76G which curves smoothly to the base 76E.

The projection 136 is shaped to engage with either groove 76C or 76D. In the former case a wall 136A of the projection is substantially complementary in shape to, and closely engages with, the side wall 76A. In the latter case a wall 136B of the projection is substantially complementary to, and is closely engaged with, the side wall 76B.

FIG. 8 shows the clip 16 in the fully assembled condition depicted, for example, in FIG. 6. It is not possible for the clip to be moved further to the left for the projection 136 closely engages with the groove 76C. If the clip is moved to the right the wall 76F presents a small degree of resistance whereafter the projection rides over the wall across the base 76E and clips into engagement with the groove 76D. It is not possible, unless excessive force is used, to slide the clip further to the right. When the clip is in the position at which the projection is engaged with the groove 76D the formations 116, 118 and 120 are respectively disengaged from the formations 50, 52 and 54. The head can then be detached from the body leaving the clip engaged with the body at a second, limiting position. The reverse procedure is followed if the head is to be secured to the body, at a second, limiting position. The user is therefore assisted, when opening or closing the flashlight, due to the fact that the movement of the clip is limited between two well-defined positions.

The oval shape of the head and of the leading end of the body mitigate against the use of thread formations to secure the head to the body, a function which, instead, is carried out by the clip.

The flashlight of the invention may be designed to be waterproof at least to a limited extent. The end 26 of the body is permanently sealed while the interface between the body and the head is sealed by means of the seal 66. The switching arrangement 44 may include flexible membranes of a kind known in the art which ensure that a watertight seal exists between external surfaces of the switch and the interior of the body. The way in which the lens 82 is fixed to the head, as is illustrated in FIG. 9, ensures that a self-sealing action results if an external surface of the lens is pressurised, for example, by being immersed in water. The increase in pressure forces the lens inwardly towards the surface 90 and, in the process, the seal 84 is compressed to a greater extent, making the seal more effective and helping to prevent the ingress of gas or fluid into an interior of the flashlight.

It is known that certain cells or batteries which are used as energy sources in flashlights can, under certain conditions, release gasses and, if these gasses are not vented to atmosphere in a controlled manner, an increase in the volume of gas can lead to a pressure build-up inside a flashlight body which can have adverse consequences. The design of the lens assembly shown in FIGS. 9 and 10 is intended to allow pressurised gas which may be present inside the flashlight to be vented to atmosphere. This is achieved through the function of the feature which has been described in that, if the pressure inside the flashlight should increase above the ambient pressure, a net force is exerted on an inner surface of the lens which tends to move the lens towards the cover 82 ie. away from the seal 84. A small leakage path is thereby created between opposing surfaces of the lens and the seal which permits gas to escape from inside the flashlight to the exterior. In this way pressure build-up inside the flashlight is limited. The gas-venting feature does not however interfere with the self-sealing feature of the lens assembly which, as noted, comes into play when an external surface of the lens is subjected to an increase in pressure relative to the pressure inside the body of the flashlight.

If the flashlight is to operate in a pressurised environment, for example under water, then apart from the need to seal the interior of the flashlight, against the ingress of moisture, it becomes necessary depending on the nature of the switching arrangement which is used to control operation of the flashlight, to take steps to seal the switch arrangement as well.

If the switch arrangement is of a conventional push or press type then the water pressure on an exterior surface of a push button can cause the button to be depressed and this can lead to operation of the flashlight in an uncontrolled manner. To counter this difficulty it is known to make use of a sliding type switch which is not affected by water pressure. However the operation of a flashlight with a push-type switch is preferable for a number of reasons.

FIG. 11 illustrates, somewhat schematically, a switch arrangement 44A which can be used with the flashlight of the invention. The switch includes a flexible rubber button 160 with an outwardly projecting flange 162 which is fixed, in a leak proof and secure manner, to an underside 164 of structure 166 of the flashlight, at any appropriate location.

The button includes two downwardly extending projections 168 and 170 respectively which overlie opposed ends of a balanced lever 172 which is mounted to a fulcrum or pivot point 174. The mounting arrangement of the lever is shown schematically only to simplify an understanding of the operation of the switch. Opposed extremities of the lever designated 176 and 178 respectively underlie the projections 168 and 170 and are positioned respectively above switches 180 and 182 fixed to support structure 184 in the interior of the flashlight.

If the flashlight is immersed in water then the water exerts a force, the magnitude of which is dependent on the depth of immersion in the water, on the button which urges the button inwardly in the direction of an arrow 190. As the water pressure is evenly distributed over the exterior surface of the button the projections 168 and 170 are moved, to the same extent, inwardly towards the structure 184. When these projections contact the extremities of the lever a balanced force is exerted via the button on opposed sides of the lever which therefore remains in the illustrated position at which neither switch 180 or 182 is actuated. Under these conditions if a user presses on a leading side 192 of the button then the button is tilted and the projection 168 contacts the extremity 176 of the lever and the switch 180 is actuated. When the user's pressure on the button is released the button reverts to its balanced state. Similarly if the trailing side of the button is depressed by a user then the switch 182 is actuated.

FIG. 11 illustrates the button 160 mounted for movement in one plane about two limiting positions. A similar technique can be used to control movement of the button in one or more transverse planes. For example by suitable design and positioning of the lever at least four functions can be obtained from a single button with a first switch being operated when a leading side of the button is depressed, a second switch being operated when a trailing side of the switch is depressed, and third and fourth switches (not shown) being operated when the left and the right sides of the button are respectively depressed.

The tubular sleeve portion 62 of the head includes a small opening 200 which may be sealed by means of a transparent cover. The bulging section 30 of the body includes a similar opening 202 which is sealed by means of a transparent cover 204. When the head is engaged with the body the two openings are brought into register. The opening 200 is positioned so that when the light emitting device 46 is actuated a small amount of stray light passes through the opening and is then immediately visible to a user via the corresponding opening in the body. This feature can help a user control the operation of the flashlight. In a variation of the invention a relatively small light emitting device 206, shown in dotted outline in FIG. 3, is associated with the head. This device is actuated only when the main light emitting device 46 is not actuated and when the flashlight is in the dark. The small light emitting device works at a lower duty cycle and consumes a minimal amount of electrical energy from the batteries in the flashlight. The light emitting device is energised at a regular intervals for a short period eg. for 100 ms during every 10 seconds so that it can function as a find-in-the-dark indicator to assist a user in locating the flashlight in the dark.

The preceeding description is directly specifically at a flashlight housing consisting of a body and a head which are secured to each other at a non-circular interface by means of a suitable clip. The same principles can however be used, in a more general sense, in the design and construction of a housing which is suitable for other applications eg. as a vessel or container, or as a housing for electrical equipment such as a radio, a GPS device, or the like.

What is claimed is:

1. A flashlight which includes a body with first and second opposed ends, an enclosure for at least one battery which is defined between the first and second ends, and a non-circular mouth at the first end, a head which is engageable with the mouth, and at least one clip which is engageable with the head and the body thereby to secure the head to the body.

2. A flashlight according to claim 1 wherein the body includes at least a first fixing formation and the head includes at least a second fixing formation, and the clip has formations which are complementary to, and which are engageable with, the first and second fixing formations.

3. A flashlight according to claim 1 wherein a first seal is located between opposing surfaces of the body and the head to seal at least the enclosure.

4. A flashlight according to claim 3 wherein a compressive force is exerted on the first seal by opposing surfaces of the body and the head when the clip is engaged with the body and the head.

5. A flashlight according to claim 1 wherein the head includes a housing for at least one light emitting device and a lens which is engageable with the housing, and a second seal which is positioned between opposing surfaces of the lens and the head.

6. A flashlight according to claim 5 wherein the head has an opening to the housing and a ledge which is located on an inner surface of the housing which extends continuously around the opening and the second seal is located on the ledge and a peripheral edge of the lens rests on the seal.

7. A flashlight according to claim 6 wherein the lens is urged into tighter engagement with the second seal if the lens is exposed to an external pressure while, if an interior of the body is pressurised, the lens is capable of moving slightly away from the ledge.

8. A flashlight according to claim 1 wherein the clip, when engaged with the body and the head, overlies portions of the outer surface of the body and the outer surface of the head.

9. A flashlight according to claim 8 wherein the body has a longitudinal axis and the head is engageable with the mouth by moving the head towards the body in the direction of the longitudinal axis.

10. A flashlight according to claim 9 wherein the clip is engageable with the head and the body by moving the clip in a direction which is transverse to the longitudinal axis.

11. A flashlight according to claim 10 wherein the clip is movable between a first limiting position at which the head is secured to the body, and a second limiting position at which the head is detachable from the body.

12. A flashlight according to claim 1 wherein the mouth of the body is substantially oval in outline and is formed on an outwardly bulging portion of the body.

13. A flashlight according to claim 12 wherein the mouth includes two relatively long and substantially linear sections which oppose one another and two opposing arcuate sections which respectively extend from ends of the linear sections.

14. A flashlight according to claim 1 which includes a waterproof switch for actuating the flashlight, the switch including a balanced lever which is mounted to a pivot point and which is pivotally movable to make or break an electrical contact.

* * * * *